US007044174B2

(12) United States Patent
Strubbe

(10) Patent No.: US 7,044,174 B2
(45) Date of Patent: May 16, 2006

(54) METHOD AND DEVICE FOR OPENING A GRIPPER CLIP OF A MECHANICAL-LOOM GRIPPER

(75) Inventor: Patrick Strubbe, Gistel (BE)

(73) Assignee: Picanol N.V., Ieper (BE)

( * ) Notice: Subject to any disclaimer, the term of this patent is extended or adjusted under 35 U.S.C. 154(b) by 175 days.

(21) Appl. No.: 10/481,416

(22) PCT Filed: Jun. 25, 2002

(86) PCT No.: PCT/EP02/06998

§ 371 (c)(1),
(2), (4) Date: Dec. 30, 2003

(87) PCT Pub. No.: WO03/004746

PCT Pub. Date: Jan. 16, 2003

(65) Prior Publication Data

US 2004/0154686 A1 Aug. 12, 2004

(30) Foreign Application Priority Data

Jul. 5, 2001 (DE) ..... 101 34 504

(51) Int. Cl.
*D03D 47/20* (2006.01)

(52) U.S. Cl. ..... 139/443; 139/444; 139/445; 139/446; 139/447; 139/448

(58) Field of Classification Search ..... 139/443–449
See application file for complete search history.

(56) References Cited

U.S. PATENT DOCUMENTS

| | | | | |
|---|---|---|---|---|
| 3,998,251 | A * | 12/1976 | Hadam | 139/448 |
| 4,127,150 | A * | 11/1978 | Steverlynck | 139/449 |
| 4,949,762 | A * | 8/1990 | Speich et al. | 139/445 |
| 5,853,032 | A * | 12/1998 | Shaw et al. | 139/449 |
| 6,866,069 | B1 * | 3/2005 | Moeneclaey et al. | 139/448 |

FOREIGN PATENT DOCUMENTS

| | | |
|---|---|---|
| EP | 1 054 088 A | 11/2000 |
| WO | WO 97 40218 | 10/1997 |

* cited by examiner

*Primary Examiner*—John J. Calvert
*Assistant Examiner*—Robert H Muromoto
(74) *Attorney, Agent, or Firm*—Bacon & Thomas, PLLC

(57) ABSTRACT

A stop element (24) is used to open a gripper clamp (20) of a weaving machine (3) and is associated to the gripper clamp's stop piece (21) and the stop element during the slow mode operation of the weaving machine is transversely moved into the path of the gripper clamp's stop piece (21) after the clamp already has moved into the vicinity of the stop element (24).

12 Claims, 3 Drawing Sheets

METHOD AND DEVICE FOR OPENING A GRIPPER CLIP OF A MECHANICAL-LOOM GRIPPER

BACKGROUND

A. Field

The present invention relates to a method for opening a gripper clamp of a gripper of a weaving machine, whereby a clamp stop piece of the gripper clamp engages a stop element which is adjustable by means of a motor drive, and to a device for carrying out said method.

B. Related Art

It is known (WO 97/40218) to adjust—at predetermined positions along the longitudinal excursion path of the gripper—a stop element for the gripper clamp stop piece using a motor drive. Said positions are predetermined by a control unit as a function of weaving parameters, illustratively depending on weaving at nominal or at low speeds. During the normal weaving operation, the stop element is positioned closer to the shed than for slow mode weaving. The higher the weaving rate, the more closely the stop element must be positioned to the shed.

Both the shed's opening/closing and the gripper position outside the shed relative to the angular position of the main drive shaft change substantially as a result of the elastic deformations of the individual components, both during slow mode and normal weaving operations.

When the loom runs at high speed in normal operation and additionally slow operation (crawling mode) for example to allow adjustments, it is possible that the stop element's set excursion in the direction of gripper excursion path sometimes will fall short.

In the slow mode, the opening of the gripper clamp should be carried out as late as possible because then problems will be minimized. Even tardy opening does not entail serious problems, because this only results in an excessively long filling waste part. Because slow mode weaving is carried out only for comparatively few filling insertions, a relatively large filling waste does not represent a serious problem. When rapidly running the weaving machine, however, there is danger that the stop element's set excursion no longer will suffice to implement the latest possible opening of the gripper clamp in slow mode.

BRIEF SUMMARY OF INVENTION

Accordingly it is the objective of the present invention to create a method of the above described type which allows early opening of the gripper clamp when the weaving machine is in normal operation at high speeds and very late opening when the machine is operating in the slow mode.

This problem is solved in that during slow loom operation, the stop element is moved into the excursion path of the gripper clamp stop piece and is associated with said stop piece when the latter already has moved into the vicinity of the stop element.

As regards the method of the invention, when the weaving machine is in the slow mode, the stop element position along the gripper's direction of motion no longer is determinative, and instead it is that time at which the stop element is associated with the gripper clamp stop piece. By that time the said stop piece may have moved over a comparatively long path in the longitudinal direction of the stop element.

The principle of such positive opening of the gripper clamp by actuating a switch or the like is already known. In the design of the state of the art, a pivotable stop element affixed in a predetermined position is actuated by a drive at a predetermined time of opening in order to establish the opening time individually for each inserted filling. Such drive is fitted with an electric motor. However this procedure entails difficulties as regards high speed weaving machines in their normal operating mode.

In a further implementation of the present invention, the gripper position is detected during slow operation and the stop element is made to cooperate with the gripper clamp stop piece at a predetermined gripper position. In particular the gripper position may be detected by means of the weaving machine main drive shaft angular position or that of a drive wheel of a gripper tape bearing the gripper.

The problem is solved according to the present invention in a further implementation by a device opening the gripper clamp of a weaving machine gripper, said device comprising means detecting the gripper position that are connected to a control unit which, during slow mode of the weaving machine, brings the stop element at a given position of the gripper into the excursion path of the stop piece of the gripper clamp and associates it to the stop piece. Appropriately, therefore, the invention provides individual electric motor drives to position the stop element along the longitudinal direction of the gripper path and to associate it transversely to said path. In this design the weaving machine may be operated in a manner such that during its slow mode, the opening procedure is controlled solely by the electric motor drive driving the stop element transversely to the gripper's path, and in normal operation the said stop element is positioned in such a way along the longitudinal direction of gripper motion path that, on account of said position, opening shall take place at an appropriate time as a function of the weaving rate and other weaving parameters.

DESCRIPTION OF THE DRAWINGS

Further features and advantages of the present invention are elucidated in the following description of the embodiments shown in the drawings and in the dependent claims.

DETAILED DESCRIPTION OF INVENTION EMBODIMENTS

Figure 1:
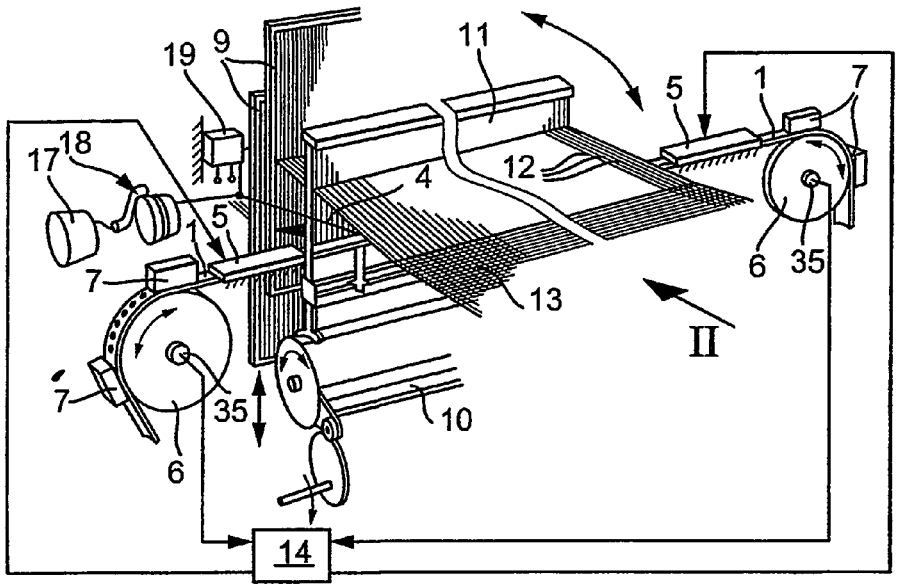
FIG. 1 schematically shows a perspective of a rapier weaving machine.
Figure 2:
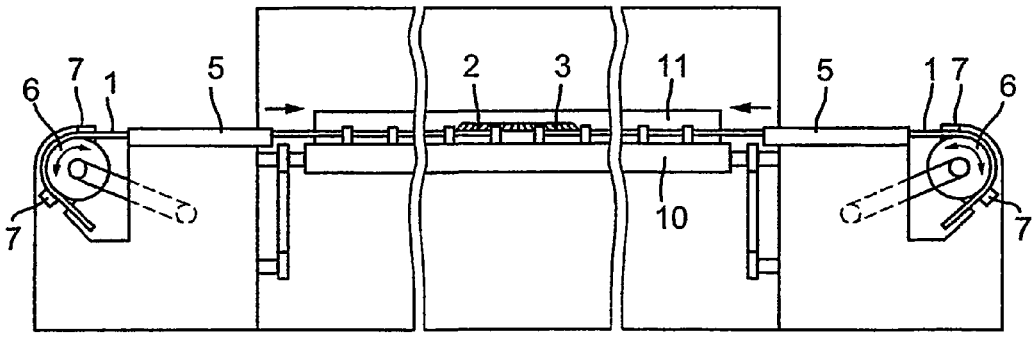
FIG. 2 is an elevation in the direction of the arrow II of FIG. 1.

The weaving machine shown in FIGS. 1 and 2 contains two gripper tapes 1, each bearing at its free end a gripper 2 and 3. The gripper 2 is the so-called donor or delivering gripper and the gripper 3 is an acceptor gripper. At the insertion side of the shed constituted of warps 12, the donor gripper 2 receives a filling 4 which is presented to it by a presenting device 19. The filling 4 is stored on a supply spool 17 from which a filling to be inserted is to be removed and rewound on a prewinder 18 before being inserted into the shed. Typically there are several spools 17 and several prewinders 18 from which the fillings are presented in a pre-selectable pattern by the presenting device 19 to the donor gripper 2. The gripper tapes 1 are powered by drive wheels 6 and are guided around these wheels by guides 7. The gripper tapes 1 move into and out again from the shed and as a result the donor gripper 2 and the acceptor gripper 3 meet centrally in the shed. Thereupon the acceptor gripper 3 receives the filling and pulls it to the opposite side. Next the inserted filling is beaten by a reed 11 against the fabric 13. The reed 11 is mounted on a batten 10 and moves in reciprocating manner.

In order to form a shed, the warps 12 are alternatingly raised and lowered by means of so-called harnesses 9. The shed is changed after the filling 4 has been inserted.

When the donor gripper 2 receives a filling 4 presented to it, a thread-clamp mounted on it must be closed. The acceptor gripper 3 also is fitted with a thread-clamp holding the filling during transport and which is opened when the acceptor gripper 3 has reached the opposite side. Closing the donor gripper 2 when receiving a filling and entering the shed is controlled by a system 5. Opening the acceptor gripper 3 in the region outside the shed and on the side opposite the insertion side is controlled by a system 5. This system 5 is elucidated in FIGS. 3 and 4 with respect to an acceptor gripper 3.

Figure 3:
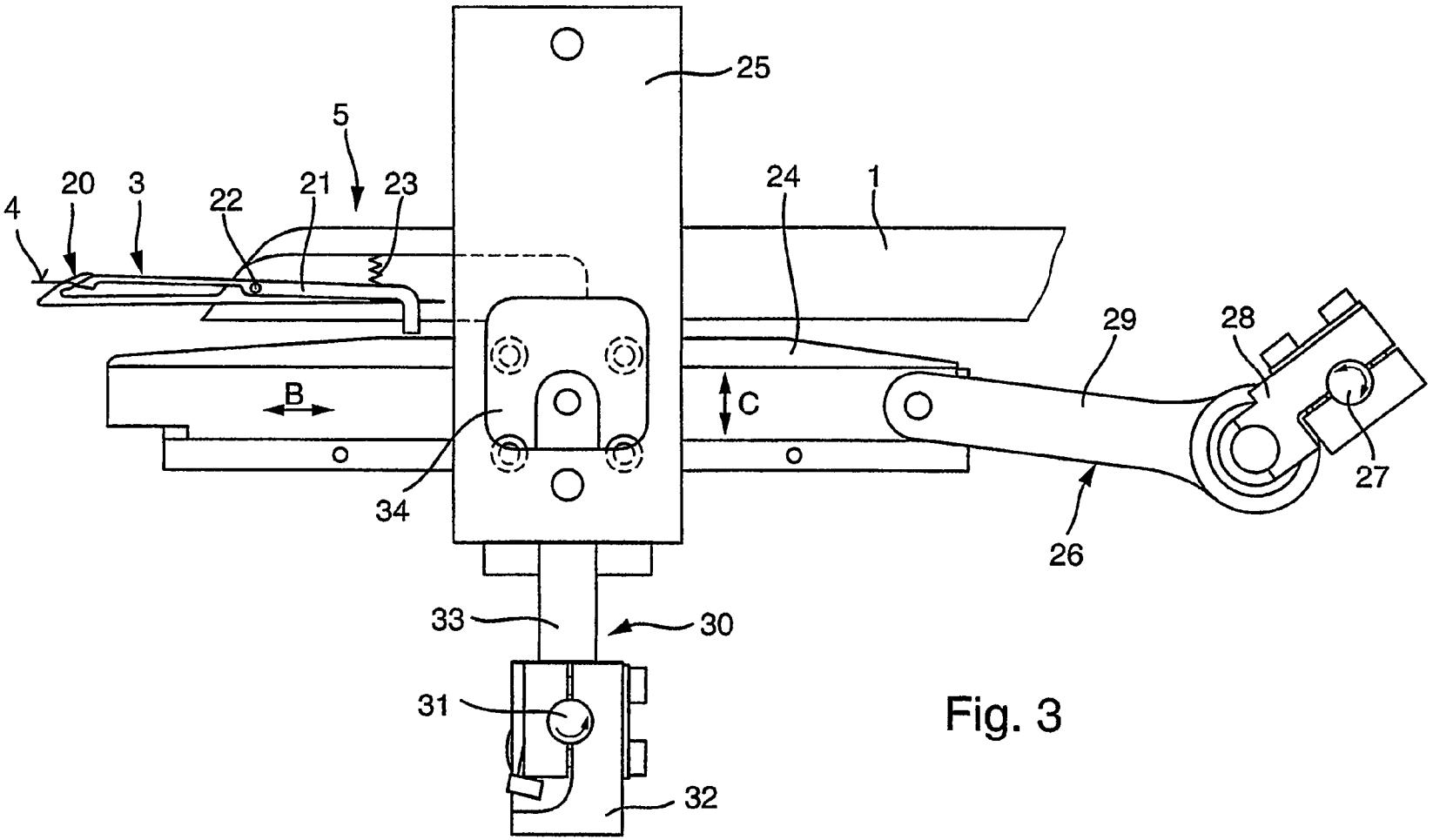
FIG. 3 is an elevation of a device opening the gripper in a given position, before the gripper will be opened.
Figure 4:
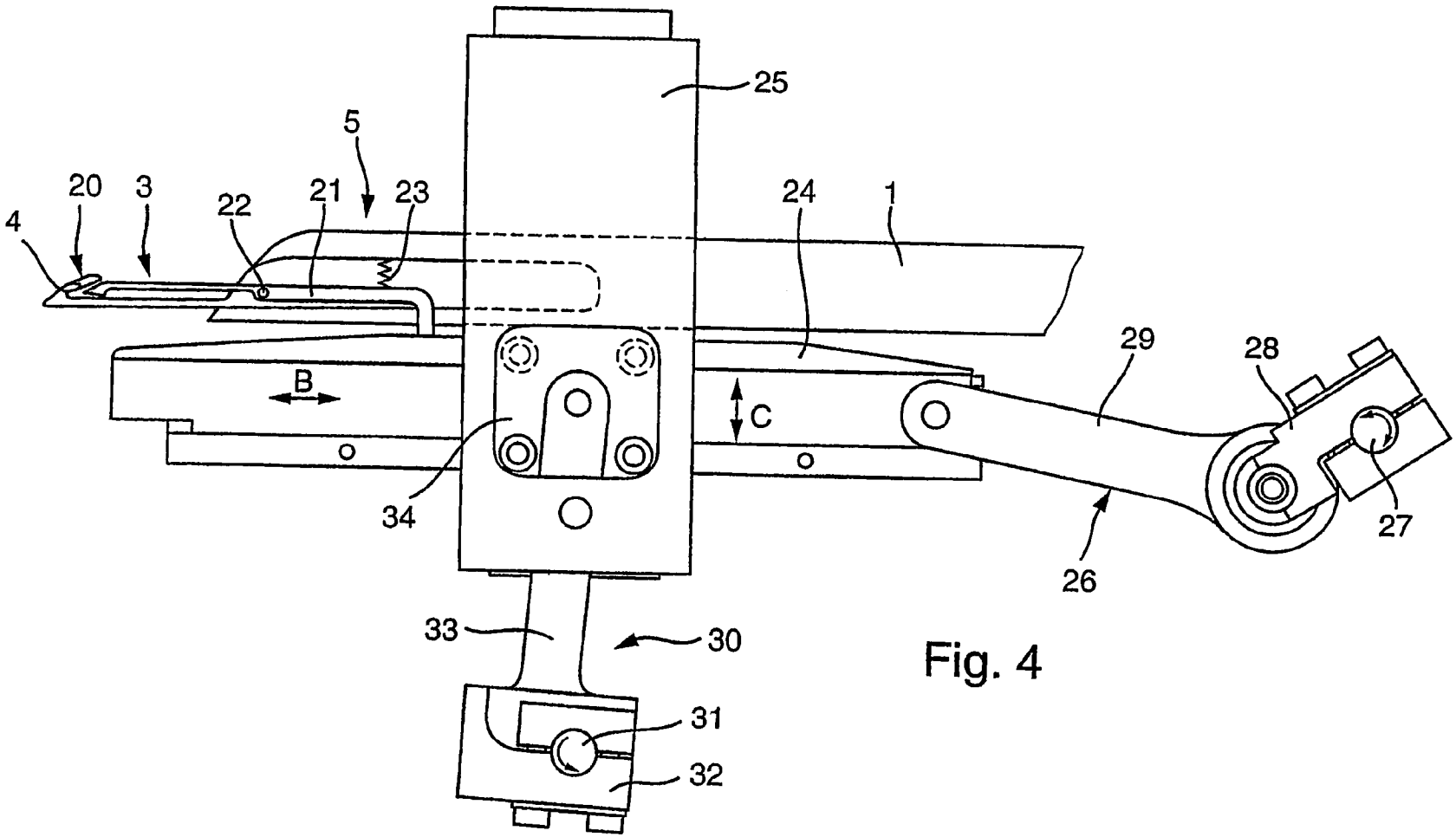
FIG. 4 shows the device of FIG. 3 when gripper is being opened.

The acceptor gripper 3 is shown in the schematics of FIGS. 3 and 4 and is affixed to the end of a gripper tape 1. Said gripper is fitted with a hook-shaped end comprising a gripper clamp 20 for a filling 4. The gripper clamp 20 is constituted by a leg of said hook and by an arm of a two-arm stop piece 21 pivotable about a pin 22. The stop piece 21 projects by a slightly flaring extension out of the acceptor gripper 3. The gripper clamp 20 will open when said extension is pressed into the acceptor gripper 3. This opening procedure is implemented by the system 5.

Said system 5 comprises a strip-shaped stop element 24 functioning as a stop for the stop piece 21 of the acceptor gripper 3. The stop element 24 is guided in a sort of compound slide 25 rigidly affixed to the loom so as to be displaceable in two mutually perpendicular directions. One direction is that indicated by the double arrow B, namely being parallel to the path of the acceptor gripper 3 and its gripper tape 1. The other direction is indicated by the double arrow C, namely running transversely to the path of the acceptor gripper 3 and the gripper tape 1.

The stop element 24 is displaced in an adjustable manner in the direction of the double arrow B by means of a drive 26 containing for instance an electric motor such as a servo or step motor, of which only the motor shaft 27 is shown. This motor shaft 27 is connected through a crank drive 28, 29 to the stop element 24 reciprocating by the drive 26 in the direction of the double arrow B, that is, it is adjustable along the longitudinal direction of the excursion path of the acceptor gripper 3.

The stop element 24 also may be adjustable by means of an electric motor drive 30 in the direction of the double arrow C. The drive 30 contains an electric motor, for instance a servo or stepping motor, of which only the motor shaft 31 is shown. The motor shaft 31 is linked by a crank drive 32, 33 to a support 34 wherein the stop element 24 is received in displaceable manner in the direction of the double arrow B. Accordingly the stop element 24 is adjustable by the electric motor drive 26 in the direction of the double arrow B and in the direction of the double arrow C by the electric motor drive 30.

When the loom is operating at the normal rate, the stop element will be in the position shown in FIG. 4, namely it will be situated in the path of the stop piece 21, as a result of which the gripper clamp 20 of the acceptor gripper will open when the extension of the stop piece 21 runs against the stop element 24. The position of the stop element 24 in the longitudinal direction of the excursion of the acceptor gripper 3 and of the gripper tape 1—and hence the distance from the shed end—is adjusted by a control unit 14 (FIG. 1) by means of the drive 26. Said position is a function of weaving parameters such as weaving rate, material and filling thickness or the like. Said position may be adjusted to fillings having different properties and also to different speeds for different filings. The pertinent values are entered by a not shown input component into the control unit 14 which illustratively selects the appropriate position corresponding to a stored program in a memory. In normal operation the drive 30 shall be activated only when, upon having reached its outermost end position, the acceptor gripper 3 reverses its motion and will be inserted into the shed. In order that in this direction the stop piece 21 is precluded from running against the stop element 24, this stop element 24 may be briefly moved by the drive 30 into the position of FIG. 3 where it is not engageable by the stop piece 21.

When the weaving machine is operated in the slow mode, the position of the stop element 24 will remain unchanged in the direction of the double arrow B. The opening of the gripper clamp 20—which in this case shall be as late as possible, namely when the acceptor gripper 3 already has moved substantially far out of the shed—is "switched" by the drive 30 implementing positive opening. The stop element 24 is moved into the position shown in FIG. 3 in a direction transverse to the path of motion of the gripper 3 and stop piece 21 and only then will it be displaced transversely by the drive 30 into the position shown in FIG. 4 if positive opening of the gripper clamp 20 is desired. This opening takes place thereupon as a function of the position of the acceptor gripper 3. Means are provided for that purpose to detect the position of the acceptor gripper 3 and to enter said position into the control unit 14 which shall then actuate drive 30 to move the stop element 24 to open the gripper clamp 20 at an appropriate time. Because the gripper tapes 1 and hence also the donor gripper 2 and the acceptor gripper 3 move synchronously with the weaving machine's main drive shaft, the opening will be set at a predetermined angular position of the main shaft. For that purpose an angular position transmitter mounted in manner not further elucidated here on the main shaft may be used, which is connected to the control unit. Because the gripper tapes 1 and hence their drive wheels 6 run synchronously with the main shaft, the positions of the grippers 2, 3 relative to the main shaft angular position may also be detected using angular position transmitters 35 mounted on the drive wheels 6 and connected to the control unit 14. As a rule one angular position transmitter 35 suffices at one of the drive wheels 6.

In principle the opening of the gripper clamp 20 of the acceptor gripper 3 also may be controlled by the drive 30 during normal rate weaving. However in most cases it will be simpler to this end to only adjust the position of the stop element 24 in the longitudinal direction of the excursion path of the acceptor gripper 3.

A device similar to the device 5 also may be used for a donor gripper 2, in which event however the opening of the donor gripper 2 would not be controlled, but instead the closing of the donor gripper 2 when seizing a filling 4 would be.

Other designs guiding the stop element 24 also are applicable as variants from the embodiments shown in FIGS. 3 and 4. In particular a stop element 24 might be used which would be pivotable about its linkage connection to the crank drive 26 in order to "switch" open the gripper clamp 20.

The invention claimed is:

1. A method of opening a gripper clamp of a gripper of a weaving machine having a slow and a fast mode of operation, and wherein a stop piece of the gripper clamp is opened by engaging a stop element along a path of motion of the gripper clamp, the position of said stop element being adjustable between stop piece engaging and stop piece non-engageable positions by a motorized drive, comprising the act:

during the weaving machine's slow mode operation, selectively moving the stop element into the stop piece engagement position from the stop piece non-engageable position after the stop piece has moved adjacent to the stop element and while the stop element is located in the stop piece non-engageable position.

2. Method as claimed in claim 1, including detecting the position of the gripper during the weaving machine's slow mode operation and carrying out moving the stop element into engagement with the stop piece of the gripper clamp at a predetermined position of the gripper.

3. Method as claimed in either of claims 1 or 2, wherein the stop element is moved into engagement with the stop piece of the gripper clamp by a dedicated stop element drive device.

4. A device for opening a gripper clamp of a weaving machine gripper having a stop element engaging a stop piece of the gripper clamp to open the gripper clamp, and wherein the position of said stop element is adjustable by an electric-motor drive, comprising:

a detector for detecting the position of the gripper along a path of motion of the gripper, said detector connected to a control unit which, during the loom's slow mode operation, and at a given position of the gripper is arranged to cause the stop element to move transversely to the gripper's moving direction into engagement with the stop piece of the gripper clamp from a location that is out of engagement with the stop piece and after the stop piece has move to a position adjacent to the stop element and to thereby engage the stop element with the stop piece and to open the gripper clamp through the actuation of the motor drive.

5. Device as claimed in claim 4, wherein said electric motor drive comprises individual dedicated electric motor drives including a first motor drive for positioning the stop element in the longitudinal direction of motion of the gripper and a second motor drive to cause engagement of the stop piece of the gripper clamp with the stop element by moving the stop element in a direction extending transversely relative to the direction of motion of the gripper from a position where the stop element is not engageable with the stop piece along its path of motion.

6. Device as claimed in claims 4 or 5, including a guide arranged to guide the motion of the stop element in the manner of a compound slide both in a direction (B) parallel to the path of motion of the gripper and in a direction ©) transversely relative to said path of motion, and including individual crank drives each powered by a respective drive motor connected to and arranged to adjust the guide position.

7. Method of opening a gripper clamp of a gripper of a weaving machine having a slow mode of operation, wherein the gripper clamp is movable along a path and is provided with a stop piece cooperating with a stop element for opening the gripper clamp by engaging the stop piece along its path of movement, and which during normal weaving operation is arranged in the path of the stop piece of the gripper clamp, comprising the act:

moving the stop element during slow mode operation by means of a motorized device out of the path of the stop piece and moving the stop element toward the stop piece for engagement with the stop piece and opening the gripper clamp after the stop piece has moved adjacent the stop element.

8. Method as claimed in claim 7, including detecting the position of the gripper along its path during the weaving machine's slow mode operation and carrying out moving the stop element toward the stop piece at a predetermined position of the gripper.

9. Method as claimed in claim 7, wherein the stop element is moved toward the stop piece by a dedicated stop element drive device.

10. A device for opening a gripper clamp of a weaving machine gripper, comprising:

a gripper clamp including a stop piece arranged to actuate opening and closing of the gripper clamp; said stop piece movable along a path;

a stop element engageable with the stop piece along the path of movement of the stop piece to cause actuation of the stop piece for opening and closing of the gripper clamp;

a motor drive arranged to move the position of said stop element relative to the path of the stop piece between a stop piece engaging position and stop piece non-engaging position;

a control unit which, during the loom's slow mode operation, is arranged to selectively cause the motor drive to move the stop element out of the path of the stop piece along its path, and to move the stop element into engagement with the stop piece along its path after the stop piece has move to a position adjacent to the stop element.

11. Device as claimed in claim 10, wherein said motor drive comprises an individual dedicated electric motor controllable to cause engagement of the stop piece with the stop element by moving the stop element in a direction extending transversely relative to the direction of motion of the stop piece from a position where the stop piece is not engageable with the stop piece, and including a second dedicated electric motor controllable to cause positioning of the stop element along a direction parallel with the direction of motion of the stop piece.

12. Device as claimed in claim 11, including a guide arranged to guide the motion of the stop element in the manner of a compound slide both in a direction (B) parallel with the path of motion of the gripper and in a direction (C) transversely relative to said path, and including individual crank drives each driven by a respective electric motor connected to and arranged to adjust the guide position.

* * * * *